US007134613B2

(12) United States Patent
Kah, III

(10) Patent No.: US 7,134,613 B2
(45) Date of Patent: Nov. 14, 2006

(54) DEVICE FOR LIMITING TURBINE ROTATION SPEED IN GEAR DRIVEN SPRINKLERS

(76) Inventor: Carl L. C. Kah, III, 1640 Australian Ave., Riviera Beach, FL (US) 33404

( * ) Notice: Subject to any disclaimer, the term of this patent is extended or adjusted under 35 U.S.C. 154(b) by 217 days.

(21) Appl. No.: 10/774,779

(22) Filed: Feb. 9, 2004

(65) Prior Publication Data

US 2005/0173557 A1 Aug. 11, 2005

Related U.S. Application Data

(60) Provisional application No. 60/445,271, filed on Feb. 6, 2003.

(51) Int. Cl.
*B05B 3/04* (2006.01)

(52) U.S. Cl. ..... 239/381; 239/240; 239/237; 239/263; 239/464; 239/570

(58) Field of Classification Search ..... 239/381, 239/240, 263.3, 237, 252, 203, 205
See application file for complete search history.

(56) References Cited

U.S. PATENT DOCUMENTS 4,026,471 A * 5/1977 Hunter ..... 239/206
5,375,768 A * 12/1994 Clark ..... 239/210
RE35,037 E 9/1995 Kah, Jr.
6,193,169 B1 * 2/2001 Steinhilber et al. ..... 239/240
2002/0074432 A1 6/2002 Kah, Jr. et al.
2002/0162901 A1 11/2002 Hunter et al.
2002/0162902 A1 11/2002 Kah, Jr. ..... 239/240

* cited by examiner

*Primary Examiner*—David A. Scherbel
*Assistant Examiner*—James S. Hogan
(74) *Attorney, Agent, or Firm*—Ostrolenk, Faber, Gerb & Soffen, LLP

(57) ABSTRACT

A turbine assembly for a rotary sprinkler head includes a flow control valve, a turbine housing having a fluid inlet and fluid outlet ports, and a rotor mounted in the housing. The flow control valve is moveable between a closed position and a maximum open position, and is spring biased towards the closed position in which all of the fluid flowing into the sprinkler head initially flows into the turbine assembly. When the flow rate through the sprinkler head is sufficient to open the valve, a portion of the fluid flow passes through the valve to bypass the turbine assembly. As the flow rate continues to increase, the valve opens further until it reaches the maximum open position. Once the valve is opened to a predetermined point, as it opens further, up to the maximum position, the valve also increasingly throttles the fluid outlet ports up to a point short of complete blockage of the outlet ports.

16 Claims, 6 Drawing Sheets

DEVICE FOR LIMITING TURBINE ROTATION SPEED IN GEAR DRIVEN SPRINKLERS

This application claims priority to U.S. Provisional Application Ser. No. 60/445,271, filed Feb. 6, 2003, the entire disclosure of which is hereby incorporated by reference.

BACKGROUND OF THE INVENTION

Rotary and oscillating sprinkler systems are widely used to irrigate lawns and landscaping in both commercial and residential environments. The most effective and reliable sprinkler systems include a series or network of pop-up sprinkler heads connected to a fluid source via irrigation pipes installed underground around the area to be maintained, an example of which is illustrated in FIG. 1. Each pop-up type rotary sprinkler head 100 generally includes a riser assembly 102 which is slidably mounted in the sprinkler head housing 104 between a fully retracted position in which the riser assembly 102 is entirely encased within the housing 104 when no fluid is flowing through the sprinkler head 100, and a fully extended position in which substantially the entire length of the riser assembly 102 extends out of the housing 104 when fluid is flowing through the sprinkler head 100 during operation of the irrigation system. A nozzle assembly 108 is rotatably attached at the top of riser assembly 102, and includes at least one nozzle 110 through which irrigation fluid is distributed out of the sprinkler head 100.

The sprinkler head housing is typically installed just beneath the ground surface 106 so that when no fluid is flowing into the sprinkler head, the riser assembly is also substantially below the ground surface. When irrigation fluid flows through the sprinkler head, the force of fluid pushes the riser assembly out of the housing until the riser assembly is fully extended to be appropriately positioned above the ground surface to deliver irrigation fluid.

FIG. 2 shows an example of a riser assembly as disclosed in U.S. Patent Application Publication No. 2002/0074432, and which includes a turbine assembly 122 having a rotor 112 and a turbine inlet 114, a gear assembly 116, and a turbine shaft 118. During operation, fluid flowing into the riser assembly enters the turbine inlet 114 and causes the turbine wheel 112 to rotate. Rotor 112 is attached to turbine shaft 118, which drives the gears in gear assembly 116.

Nozzle assembly 108 is rotatably connected to the riser assembly 102 by an output shaft 120, which also defines the flow path of fluid from the riser assembly 102 into the nozzle assembly 108. As such, irrigation fluid flows upwardly through the riser assembly 102 and is channeled into output shaft 120 and out through nozzle 110. In the riser assembly 102, output shaft 120 is driven by the output of gear assembly 116, whereby rotation of the output shaft 120 is thereby controlled by the movement of the gears in the gear assembly 116. The gears may be configured to rotate the output shaft 120 continuously or in an oscillating manner through a predetermined arc, as disclosed, for example, in U.S. Pat. No. RE 35,037 to Kah, Jr. and U.S. Patent Application Publication No. 2002/0074432 to Kah, Jr. et al., the disclosures of which are both incorporated herein by reference.

In climates which experience freezing temperatures during the year, irrigation systems such as those described above must be drained or blown-out with air after seasonal use to clear any water out of the system to prevent freezing damage. In many cases, the simplest installation provides only for allowing the irrigation system pipes and sprinkler heads to be cleared of water by blowing out compressed air through the system. This can be very damaging to the turbines, which normally rotate at a much slower speed when driven by water. Air is an expandable fluid and is relatively light compared to water, which is a relatively incompressible fluid and does not generate the rotational velocities produced when air is expanded in the turbine assembly onto the rotor blades.

Unless care is taken to limit the system air, blow-out time and pressures, the high turbine shaft velocities resulting from blowing compressed air through the sprinkler system can heat the shaft and cause it to seize to the plastic housing material. Once this occurs, the rotor is prevented from turning any further and is rendered unusable in the future. This has proved to be one of the major causes for premature failure of gear driven sprinklers in colder climates, where sprinklers are used for only part of the year and would therefore be expected to last much longer than in warmer climates, where they are run year round. Accordingly, the longevity of gear driven sprinkler systems in colder climates would be greatly enhanced if such systems were equipped with means to prevent the turbine rotor from rotating at excessively high velocities when driven with compressed air.

At least one device is known for preventing excessive rotational speed in turbine-driven sprinklers. One such device is disclosed in U.S. Patent Application Publication No. 2002/0162901 to Hunter et al., in which a brake force is applied to the rotor in a turbine assembly in a rotary sprinkler head when compressed air is flushed through the sprinkler system. To achieve this result, the turbine assembly includes a float mechanism which may be seated on the turbine rotor or blocks the flow path to the rotor when air is flowing through the sprinkler head, and is lifted off the rotor or removed from obstructing the flow path when water is delivered therethrough. The default position of the float mechanism is in the position to hinder rotation of the turbine rotor, but its buouyancy in water causes the float mechanism to be moved in the direction of flow so as to enable the turbine to rotate freely when water flows through the sprinkler head.

Even with water flowing through the sprinkler system, however, the sprinkler heads may wear out faster with continued operation at high fluid output rates than at lower output rates. In particular, certain types of rotary irrigation sprinkler systems provide the capability to adjust the output rates and/or change between several different nozzles for applying a selected flow rate and/or distribution profile of the irrigation fluid. Changes in the output flow rate caused by changing the nozzles also affect the flow rate driving the turbine rotor which rotates the sprinkler head. This is generally the case with most known rotary sprinklers, including the system disclosed in Hunter and discussed above. When the irrigation fluid flowing through the sprinkler system disclosed in Hunter is water, the rate of rotation of the turbine assembly is directly determined by the flow rate of water through the system, and would therefore vary through the entire operation range of the sprinkler system.

Because water is an incompressible fluid, as the selected output rate from the sprinkler increases, the faster the velocity of water passing through the turbine assembly. The faster the velocity of water entering the turbine assembly, the faster the rotor is driven by the water striking the rotor blades. Therefore, it would be advantageous to maintain the rotational velocity of the turbine rotor as constant as possible for as great a range of flow rates as possible for both air and water.

SUMMARY OF THE INVENTION

A first aspect of this invention provides a turbine-driven sprinkler head which incorporates a speed limiting mechanism which protects the turbine from damage when compressed air is used to blow out the system in preparation for winter, but still permits satisfactory operation when the turbine is water-driven.

A second aspect of the invention provides a turbine-driven sprinkler head having a speed limiting mechanism for air (compressible flow) which is reliable and can be manufactured inexpensively.

A third aspect of the invention provides a turbine-driven sprinkler head having a speed limiting mechanism which maintains a substantially constant rotational velocity of the turbine for a range of flow rates when the irrigation fluid is an incompressible fluid such as water.

A fourth aspect of the invention provides a turbine-driven sprinkler head which incorporates a speed limiting mechanism which maintains the rotational velocity of the turbine rotor as constant as possible for as great a range of flow rates as possible regardless of the content of the irrigation fluid through the sprinkler system.

The present invention includes a turbine assembly for a rotary sprinkler head which includes a turbine housing, a fluid inlet to the turbine housing, a rotor mounted in the turbine housing, at least one fluid outlet from the turbine housing, and a flow control valve which is spring biased towards the closed position, whereby all of the fluid flowing into the sprinkler head is initially allowed to flow through the turbine assembly to thereby drive the rotor. When the fluid flow into the sprinkler head is increased to a first flow rate which generates a force against the valve sufficient to counteract the force of the spring, the valve is opened, and a portion of the fluid flow is diverted around the turbine assembly to flow directly to the nozzle assembly. As the flow rate increases from the first flow rate, the flow control valve continues to open up to a predetermined amount.

The flow control valve is constructed so as to throttle the at least one fluid outlet from the turbine housing once the flow rate through the sprinkler head reaches a second flow rate. As the flow rate increases from the second flow rate, the flow control valve increasingly restricts fluid flow out of the turbine housing until the flow control valve reaches its maximum open position.

Preferably, the flow control valve is slidingly fitted around the turbine housing and includes a sleeve for throttling a plurality of exit ports from the turbine housing.

These and other features and advantages of the invention will become apparent from the following detailed description, which is provided in connection with the accompanying drawings and illustrate exemplary embodiments of the invention.

DETAILED DESCRIPTION OF THE INVENTION

Figure 1:
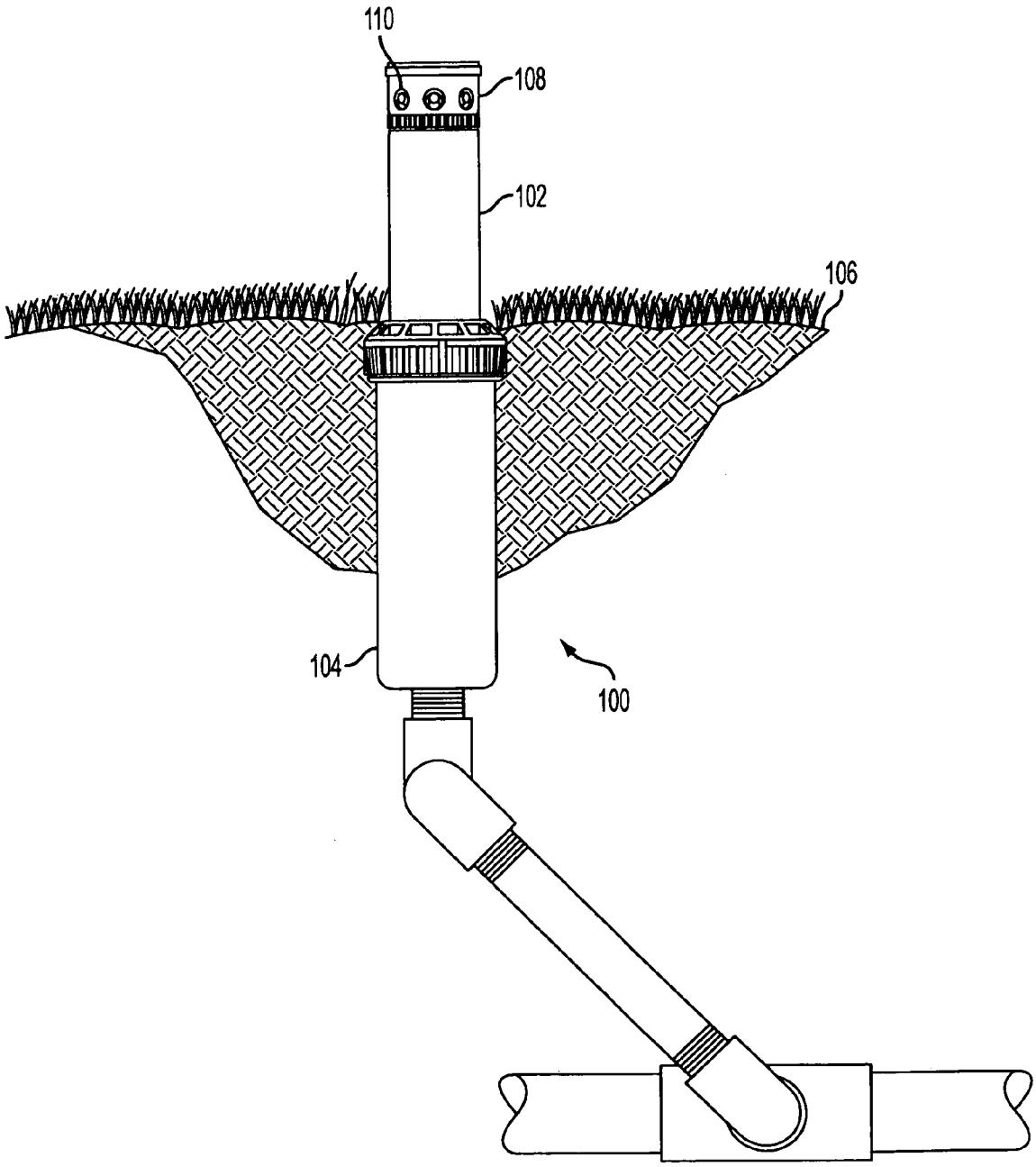
FIG. 1 PRIOR ART
FIG. 1 illustrates a pop-up rotary sprinkler head as generally known in the art.
Figure 2:
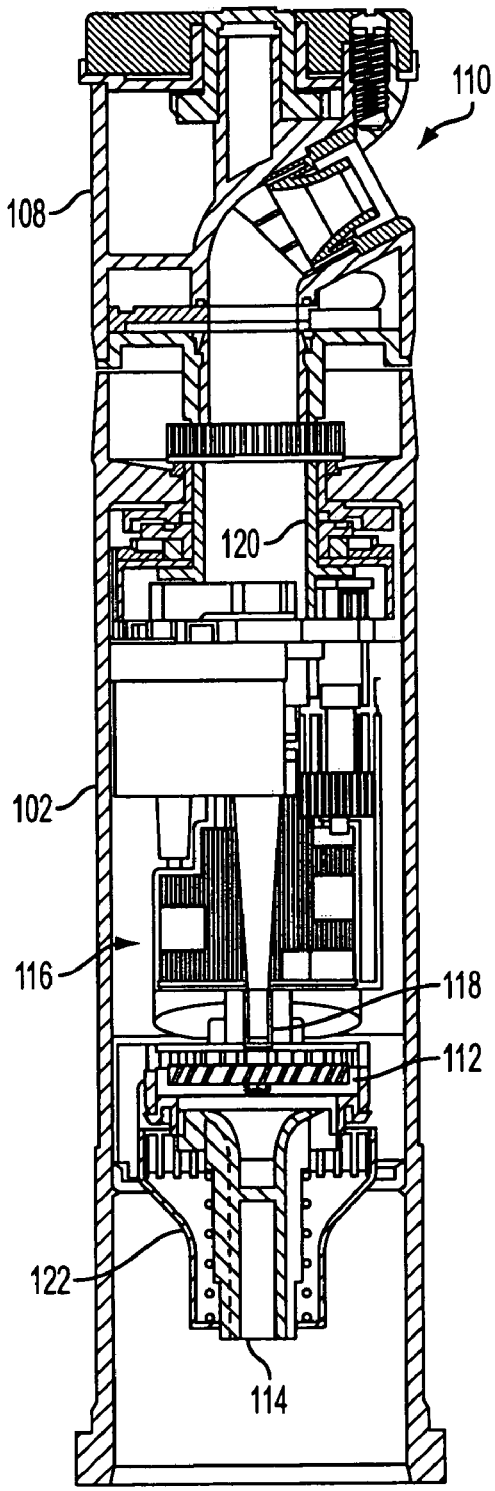
FIG. 2 PRIOR ART
FIG. 2 is a cross-sectional view of an exemplary pop-up rotary sprinkler head as known in the art.
Figure 3:
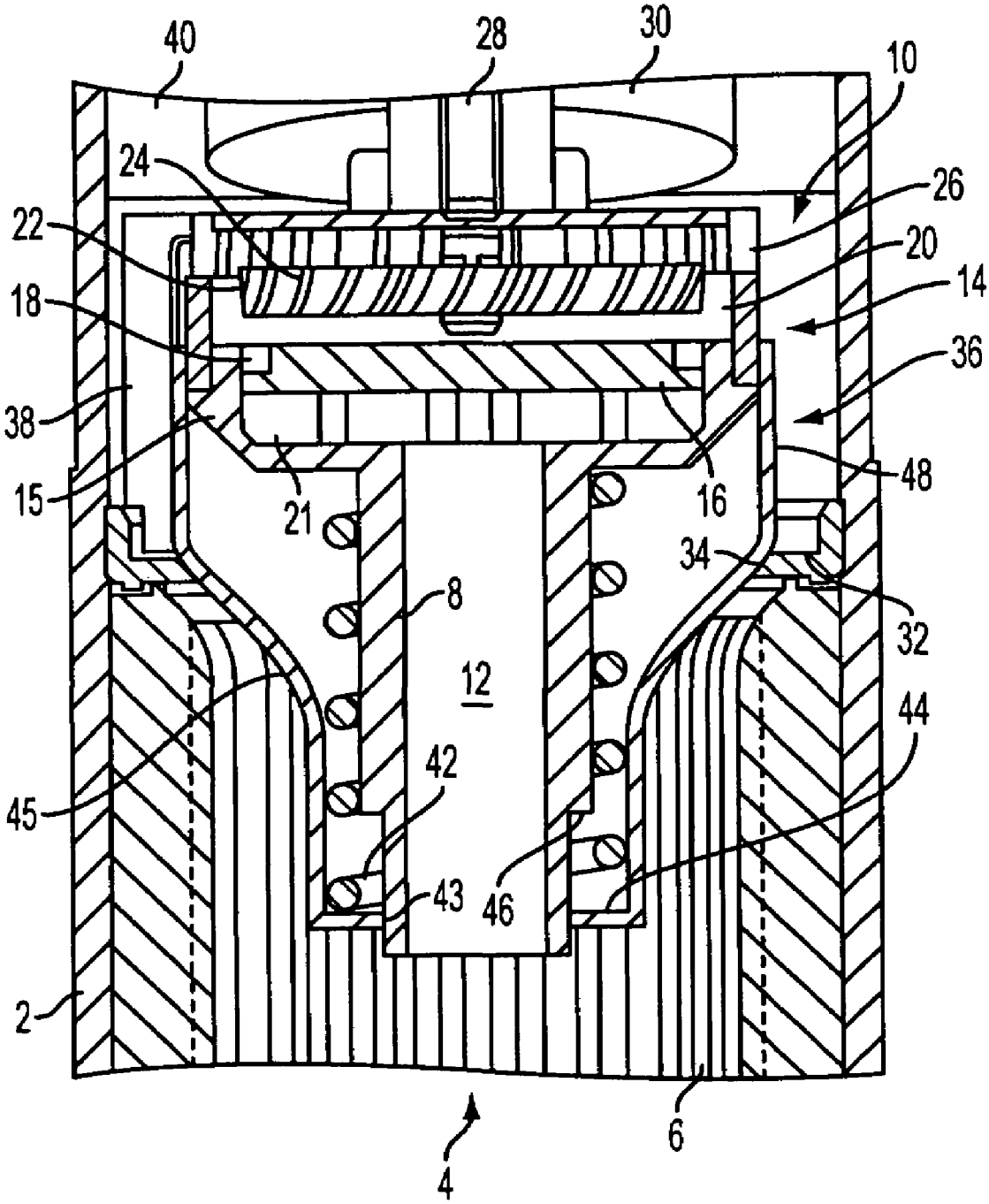
FIG. 3 is a cross-sectional view of a preferred embodiment of a turbine assembly in accordance with the present invention, wherein the flow control valve is in the closed position.
Figure 4:
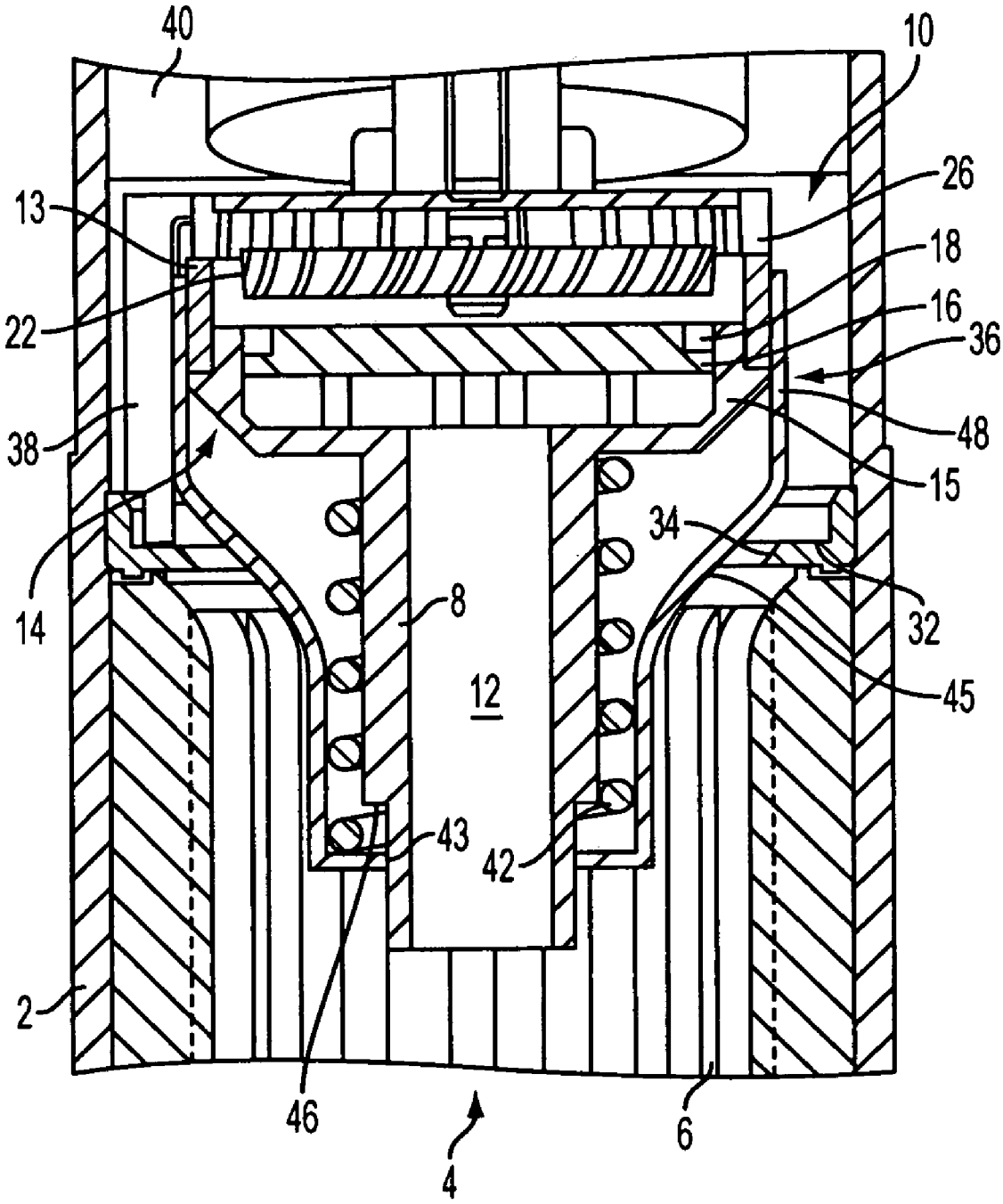
FIG. 4 is a cross-sectional view of the turbine assembly shown in FIG. 3 in which the flow control valve is in an open position.
Figure 5:
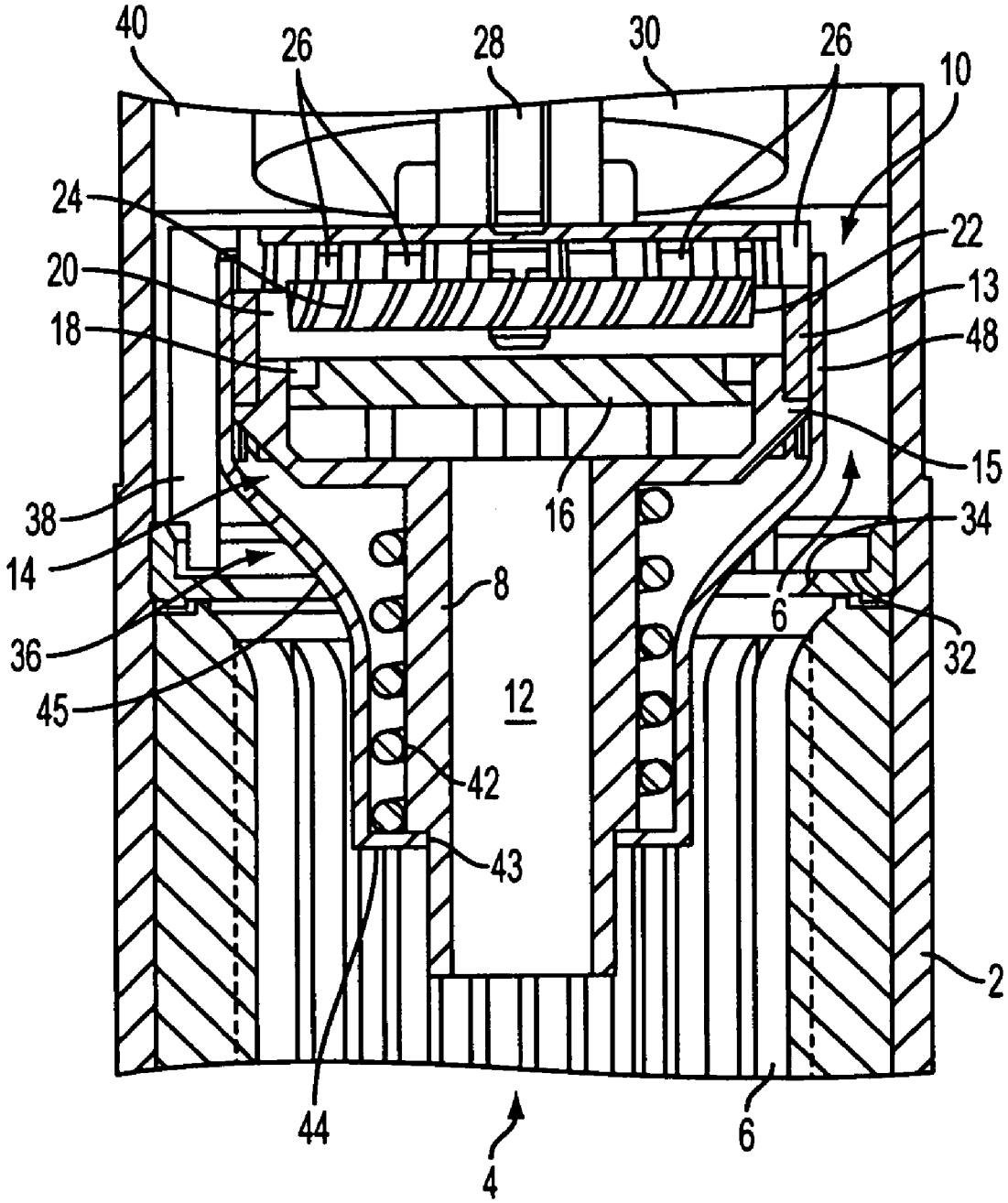
FIG. 5 is a cross-sectional view of the turbine assembly shown in FIG. 3 in which the flow control valve is in the maximum opened position and the outlet ports of the turbine housing are throttled.

The turbine assembly 10 according to a preferred embodiment of the present invention is shown in cross-section in FIGS. 3–5. Generally, turbine assembly 10 includes a rotor 22, a turbine housing, 14, an aperture plate 16, and a flow control valve 36.

Figure 6:
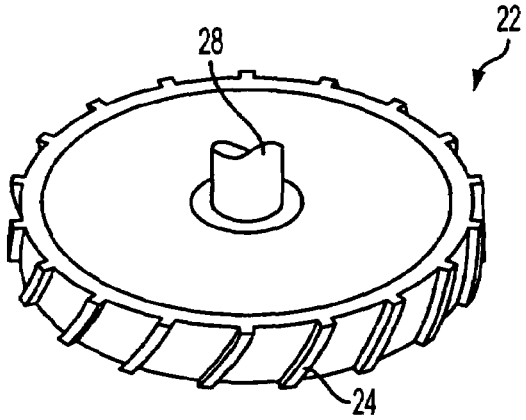
FIG. 6 shows an exemplary turbine rotor which may be incorporated in the turbine assembly in accordance with the present invention.

Rother 22 has a plurality of blades 24 angularly formed around its perimeter (seen more clearly in FIG. 6), and is affixed to an output shalt 28, which in turn is connected to a gear train inside a gear box 30. When the rotor 22 is driven as described below, the gear train in gear box 30 is driven to ultimately cause a sprinkler head (not shown) to rotate in one direction or to oscillate through a predetermined arcuate range. Irrigation fluid is output through the sprinkler head while the sprinkler head is rotating and/or oscillating, to distribute the fluid across a predetermined range and trajectory profile.

Figure 7:
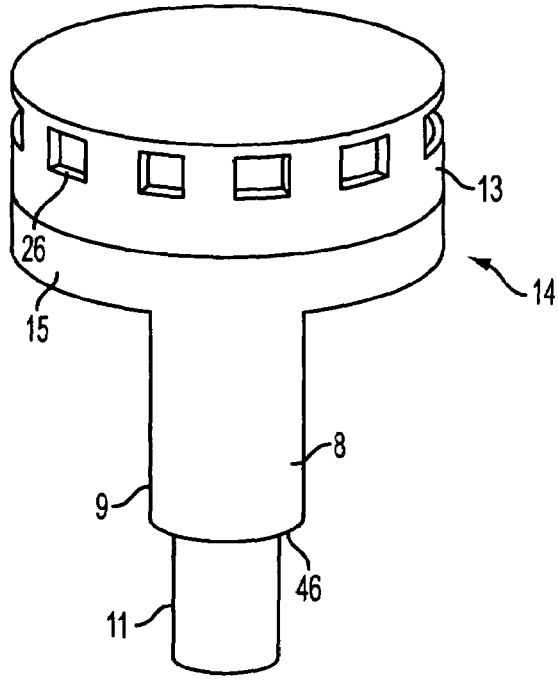
FIG. 7 shows the aperture plate fitted in the turbine housing according to the present invention.

Rotor 22 is housed inside turbine housing 14, which includes an upper housing section 13 shaped substantially like a petri dish, a substantially bowl-shaped lower housing section 15 and an inlet tube 8. The upper housing section 13 is fitted over the lower housing section 15 like a cap, and the inlet tube 8 extends downwardly from a center opening in the lower housing section 15 having a diameter corresponding to the inner diameter of the inlet tube 8. Preferably, though not necessarily, the inlet tube 8 is integrally formed with the lower housing section 15. As shown in FIG. 7, inlet tube 8 has a first exterior diameter along its upper portion 9, and a second exterior diameter which is smaller than the first exterior diameter along its bottom portion 11, for reasons which will be explained below. Due to the difference in exterior diameters of the upper portion 9 and the bottom portion 11, a shoulder 46 is formed around of the inlet tube 8 at the junction between the two portions. As can be seen in FIGS. 3–5 and 7, the turbine housing 14 as defined byte upper housing section 13, the lower housing section 15 and the inlet tube 8 forms a structure which is cylindrically symmetrical about a central vertical axis and has a vertical cross section shaped like a hollow "T."

Figure 8:
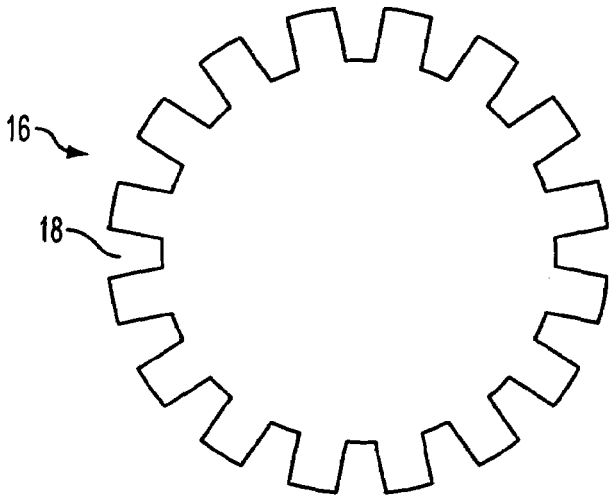
FIG. 8 is a perspective view of the turbine housing incorporated in the turbine assembly according to the present invention.

A plurality of outlet ports 26 are formed through and spaced around the upper portion of the cylindrical wall of upper housing section 13. An aperture plate 16 (see FIG. 8) is fitted in the housing 14 at the top of lower housing section 15, to thereby divide the space enclosed between the upper and lower housing sections 13 and 15 into rotor chamber 20 and lower turbine chamber 21. Aperture plate 16 includes apertures 18 spaced around its periphery to establish fluid communication from the lower turbine chamber 21 to the rotor chamber 20. The size and position of the apertures 18 in the aperture plate 16 are such that fluid entering rotor chamber 20 through apertures 18 flows directly as possible to the blades 24 of the turbine rotor 22 to thereby drive the rotor 22. Additionally, the total area of the outlet ports 26 is preferably substantially equal to or slightly larger than the total area of apertures 18 between in the aperture plate 16. When constructed in this manner, the flow rate entering the rotor chamber 20 will also exit the rotor chamber 20 at the same flow rate, absent any obstructions to fluid flow through the outlet ports 16 and assuming that the irrigation fluid is a compressible fluid.

In a sprinkler head which incorporates the turbine assembly according to the present invention, fluid thus travels through the turbine assembly by entering through the inlet passage 12 in the inlet tube 8, flowing into the lower turbine chamber 21 under the aperture plate 16, passing through the apertures 18 in the aperture plate 16 and into the rotor chamber 20, and exiting through the outlet ports 26, where the fluid then continues to flow upwardly through the sprinkler head to be distributed out of the sprinkler head via the nozzle assembly.

A flow control valve 36 is, in an exemplary embodiment of the invention, substantially Y-shaped in cross-section, and includes a planar bottom end 44, a curved fluid contact surface 45, and a sleeve 48. The bottom end 44 has a central opening formed therethrough having a diameter corresponding to the exterior diameter of the lower portion 11 of inlet tube 8. The outer diameter of bottom end 44 is somewhat larger than the exterior diameter of the upper portion of inlet tube 8. The flow control valve 36 widens from the outer diameter of the bottom end 44 to the diameter of the sleeve 48, which corresponds with the exterior diameter of the turbine housing 14 along the cylindrical wall formed by the upper housing section 13 and lower housing section 15. The fluid contact surface 45 is defined by this variable diameter section of the flow control valve 36 between the bottom end 44 and the sleeve 48.

The bottom portion 11 of the turbine inlet tube 8 is fitted through the opening 43 in the bottom end 44. A spring 42 is arranged inside flow control valve member 36 surrounding turbine inlet tube 8 between the bottom end 44 and the bottom surface of the lower housing section 15 of interior turbine housing 14. The spring 42 biases the bottom end 44 of flow control valve 36 to a position along the inlet tube 8 near the opening to the turbine inlet passage 12 at the bottom of the inlet tube 8.

As seen in FIG. 3, the turbine assembly 10 is positioned inside a riser housing 2 so that the turbine inlet passage 12 opens into the main flow passage 6 through riser housing 2. The position of the turbine assembly 10 and the gear box 30 inside the riser is fixed to prevent vertical movement of the turbine assembly 10 relative to the housing 2. An annular flange 32 is formed around the inner surface of housing 2, and defines a valve seat 34 around its inner circumference.

When no fluid is flowing through the sprinkler head, there is no force being applied against the flow control valve 36, and therefore the flow control valve 36 rests on the valve seat 34 as illustrated in FIG. 3. The spring 42 is pre-compressed (biased) to a force sufficient to hold the flow control valve 36 in the closed position on the valve seat 34 until a flow rate of fluid through the sprinkler head causes the pressure across flow control valve 36 to exceed the pre-compressed force of spring 42.

In an initial period of operation of the sprinkler system, the irrigation fluid source is opened to allow irrigation fluid to begin flowing to the sprinkler head. The flow of fluid enters the riser housing 2 into the main flow passage 6 thereof, and then into the turbine inlet passage 12 and through the turbine assembly as described above. As fluid flows into the main flow passage 6 of riser housing 2, the fluid pressure pushes against the fluid contact surface 45 of the flow control valve member 36. During this initial period of operation, the pressure exerted on the fluid contact surface 45 by the flow of fluid is less than that necessary to unseat the flow control valve member 36 from its seat. Accordingly, the upper portion of sleeve 48 contacts and surrounds the turbine housing 14 but remains below the position of the outlet ports 26, and all of the fluid flow passes through the turbine assembly 10, with the turbine outlet ports 26 fully uncovered by sleeve 48.

When the force of the irrigation fluid against the fluid contact surface 45 is sufficient to overcome the pre-compressed force of the spring 42, the flow control valve 36 is lifted off the valve seat 34 such that the bottom end 44 slides along the bottom portion 11 of the inlet tube 8, as illustrated in FIG. 4, to enable a portion of the irrigation fluid flow to enter the flow bypass region 38 through the opening between the annular flange 32 and the flow control valve 36. Upon opening the flow control valve 36, any fluid flowing into the bypass region 38 does not enter the turbine flow path and does not contribute to driving the rotor 22. The portion of the fluid flow bypassing the turbine assembly recombines with the portion of flow passing trough the turbine assembly after the latter exits the rotor chamber 20, whereby the entire flow continues to pass through the riser assembly and into the nozzle assembly, where the fluid is discharged through the nozzle(s) in the nozzle assembly.

The extent to which the valve 36 is opened by a given flow rate through the sprinkler head is controlled by the pre-compressed tension of the spring 42 and the spring constant k. As the flow rate through the sprinkler head increases, the additional differential pressure across the turbine assembly caused by the tension of spring 42 upon further compressing the spring is compensated for by the further upward movement of the flow control valve 36, which causes the sleeve 48 to begin to cover the turbine outlet ports 26.

As the flow rate into the riser housing 2 is increased, the flow control valve 36 is pushed further upwards relative to the valve seat 34. As the valve 36 is pushed upwards, the top of sleeve 48 becomes aligned with the bottom of the outlet ports 26, whereupon further movement of the valve 36 causes the sleeve 48 to constrict the exit area of the outlet ports 26, thus restricting the rate of flow out of chamber 20.

When the irrigation fluid is an incompressible fluid such as water, restricting the size of the exit area through the outlet ports 26 causes the flow rate exiting the rotor chamber 20 to be reduced. Since an incompressible fluid can only enter the rotor chamber 20 at the same rate the fluid exits the rotor chamber 20, reducing the exit rate out of the rotor chamber 20 likewise restricts the rate of fluid entering chamber 20. While the input rate of fluid to the rotor chamber 20 for driving the rotor 22 is thus reduced by the position of the sleeve 48 of the flow control valve 36, the fluid flow rate through the sprinkler head has not been reduced, and may even be continuing to increase. This causes more of the fluid flow to bypass the turbine assembly than would be the case if the flow rate exiting the turbine assembly were not being restricted.

Of course, it is understood that as the flow rate through the sprinkler head increases from the flow rate at which the flow control valve 36 is first opened and the flow rate at which the flow control valve 36 begins to throttle the turbine outlet ports 26, the portion of the total flow rate bypassing the turbine assembly also increases in relation to the further opening of the flow control valve 36. During this phase of operation, where the flow control valve is being further opened but before the outlet ports 26 of the turbine assembly 10 are constricted, the flow rate through the turbine assembly may continue to increase, despite the increasing proportion of flow bypassing the turbine assembly, albeit any rate of increase through the turbine assembly is significantly slower than would occur without the bypass operation of the flow control valve 36. The present invention eliminates this variability in turbine speed over the range of flow rates in which the outlet ports 26 of the turbine assembly 10 are constricted. By throttling the flow rate exiting the turbine assembly in addition to diverting a portion of the flow at the inlet of the turbine assembly, the present invention provides an additional means for controlling the flow rate through the turbine assembly. The invention therefore enables the rotational speed of the rotor inside the turbine assembly to be maintained more reliably at a substantially constant level through a wider range of fluid flow rates through the sprinkler head than in prior art rotary sprinkler heads having only a bypass valve at the turbine inlet.

The maximum open position of the flow control valve 36 is determined by the position of the shoulder 46 formed around the inlet tube 8 at the junction of upper portion 9 and lower portion 11 of inlet tube 8. When the flow control valve 36 is opened to the position where the end surface 44 abuts the shoulder 46, the valve is prevented from being pushed any further upward, as shown in FIG. 5. Even at this position, a least a portion of the outlet ports 26 remain uncovered by the valve sleeve 48, since if the outlet ports 26 were blocked completely, no fluid would be able to exit the rotor chamber 20, and the rotor would stop turning due to the prevention of fluid from flowing into the chamber 20.

In an exemplary embodiment of the present invention, the turbine assembly and the associated sprinkler head components are sized and constructed so that the flow control valve 36 is opened, or forced off the valve seat 34, with an output flow rate (from the sprinkler head as a whole) of at least ½ gallons per minute (gpm) of an incompressible fluid such as water, and begins to restrict the size of the outlet ports 26 at an output flow rate of approximately 4 gpm, and maintains a constant turbine rotation speed up to an output flow rate of approximately 8 gpm. In another exemplary embodiment of the invention, the turbine assembly and the associated sprinkler head components are sized and constructed so that the flow control valve 36 maintains a constant turbine speed through an output flow rate range of between about 5 gpm to about 30 gpm. Of course, other constant speed operating ranges may be provided as desired.

The output flow rate range for which the rotation of the turbine rotor can be maintained at a constant speed may be controlled by several factors, including but not limited to, the spring constant of the spring 42, the level of pre-tension biasing the spring in the valve closed position, the initial exit area of the outlet ports 26, and the length of valve sleeve 48. Thus, depending on the intended applications and design capacities of a sprinkler system, the variables listed above may be adjusted accordingly at the manufacturing stage to achieve constant turbine speed over as much of the operational range of the sprinkler system as possible As mentioned above, in rotary sprinkler systems incorporating a turbine arrangement which does not compensate for the increasing pressure differential across the turbine assembly, the speed at which the rotor is driven directly depends upon the flow rate and velocity at which the fluid enters the rotor chamber 20 and strikes the turbine blades 24. As such, the rotation of the rotor 22, and hence the rotation of the nozzle head, speeds up as a greater flow rate is output from the sprinkler, and slows down as the flow rate is decreased. In contrast, the capability to throttle the turbine output flow rate in addition to controlling the flow rate into the turbine assembly at its inlet end in accordance with the present invention enables truly constant turbine speed operation in a rotary sprinkler system.

In addition to providing more consistently constant operation speed over a wide range of irrigation flow rates, the present invention also advantageously prevents the turbine rotor from rotating with excessive speed during the performance of winterization procedures in which compressed air is forced through the sprinkler head to clear out any remaining irrigation fluid at the end of the irrigation season in colder climates. Since excessive rotational speed of the turbine caused by the rapid decompression of the compressed air passing through an unprotected turbine assembly causes the rotor to turn at a much higher rate than normally achieved with a flow of an incompressible fluid such as water, the output shaft 28 is caused to heat up, which may damage the bearing surrounding the shaft 28 and destroy the rotational or oscillating operation of the sprinkler head. The present invention addresses this problem in dual fashion by diverting a significant portion of a flow of compressed air through the bypass flow path around the flow control valve 36 at the inlet end of the turbine assembly, and also by choking the flow path at the output end of the turbine assembly.

The present invention as described herein provides more consistent rotary operation of a gear driven sprinkler system over a wider operating range in terms of output flow than previously achievable with currently available sprinkler systems. While the invention has been described in detail in connection with preferred embodiments known at the time, it should be readily understood that the invention is not limited to the disclosed embodiments. Rather, the invention can be modified to incorporate any number of variations, alterations, substitutions or equivalent arrangements not heretofore described, but which are commensurate with the spirit and scope of the invention. Accordingly, the invention is not limited by the foregoing description or drawings, but is only limited by the scope of the appended claims.

The invention claimed is:

1. A gear driven sprinkler comprising:

a main housing having a main fluid inlet;

a turbine assembly mounted in the main housing, wherein the turbine assembly includes:

a turbine housing having an inlet and an outlet, and defining a rotor chamber therein;

a rotor rotatably mounted in the turbine housing, wherein the rotor is rotated by a flow of fluid through the turbine housing; and a flow control valve slidably engaged with the turbine housing to move between a first position and a second position, wherein the second position allows fluid flow through the main housing to bypass the inlet port to the turbine housing and throttles the outlet of the turbine housing.

2. The sprinkler according to claim 1, wherein the main housing includes a valve seat, and the flow control valve includes a fluid contact surface for engaging the valve seat in the closed position, and a sleeve disposed around the turbine housing for throttling the outlet of the turbine housing.

3. The sprinkler according to claim 2, further comprising a third position of the flow control valve between the first and second positions such that the sleeve does not throttle the outlet of the turbine housing when the flow control valve moves between the first and third positions, and increasingly throttles the outlet of the turbine housing when the flow control valve moves from the third position to the second position.

4. The sprinkler according to claim 3, wherein the turbine assembly is constructed such that the rotor rotates at a constant speed as the fluid flow trough the turbine housing increases from a rate which places the flow control valve in the third position to a rate which places the flow control valve in the second position.

5. The sprinkler according to claim 3, wherein the flow control valve includes:

a first element operative to close a bypass path around the turbine housing when the valve is in the first position, and to open the bypass path when the valve is in not the first position; and a second element which partially blocks the outlet of the turbine housing to control the flow of fluid through the turbine housing when the valve is in the second position.

6. The sprinkler according to claim 5, wherein:

the main housing includes a valve seat, and the first element of the flow control valve includes a fluid contact surface which cooperates with the valve seat to open and close the bypass path.

7. The sprinkler according to claim 5, wherein:

the turbine housing outlet is comprised of a fluid passage permitting fluid flow from the rotor chamber to the sprinkler head; and the second element is a member movable relative to the turbine housing outlet to vary the outlet flow area.

8. The sprinkler according to claim 7, wherein the second element is a sleeve which surrounds the turbine housing and is slidably engaged therewith.

9. A gear driven sprinkler comprising:

a sprinkler head;

a main housing having a main fluid inlet;

a turbine assembly mounted in the main housing, and coupled to drive the sprinkler head, wherein the turbine assembly includes:

a turbine housing defining a rotor chamber therein;

a rotor mounted in the turbine housing which is rotated by a flow of fluid through the turbine housing from the main fluid inlet; and a flow control valve movable between a first position at which the valve has substantially no effect on the flow of fluid through the turbine housing, and a second position at which the valve allows a portion of the fluid flow from the main fluid inlet to bypass an inlet to the turbine housing and restricts the flow of fluid through an outlet of the turbine housing.

10. The sprinkler according to claim 9, wherein the flow control valve is movable by a first preset level of force transmitted by fluid flowing from the main fluid inlet from the first position to the second position.

11. The sprinkler according to claim 10, wherein the flow control valve is movable by a second preset level of force less than the first preset level from the first position to a third position intermediate the first and second positions such that the flow of fluid through the outlet of the turbine housing is not restricted when the flow control valve moves between the first and third positions, but is increasingly restricted when the flow control valve moves from the third position toward the second position.

12. The sprinkler according to claim 11, wherein the preset levels of force are determined by a resilient member which biases the valve toward the first position.

13. The sprinkler according to claim 11, further including a limit member which prevents the valve from traveling beyond the second position.

14. The sprinkler according to claim 9, wherein the flow control valve is movable to a third position intermediate the first and second positions such that the flow of fluid through the outlet of the turbine housing is not restricted when the flow control valve moves between the first and third positions, but is increasingly restricted when the flow control valve moves from the third position toward the second position.

15. A method of operating a rotary sprinkler at a constant turbine speed, comprising:

delivering a flow of fluid from a supply to a turbine assembly mounted in the sprinkler;

driving a rotor in the turbine assembly by contacting the rotor with the fluid as it flows through the turbine assembly;

diverting a portion of the fluid flow to bypass the turbine assembly in response to a force generated by the flowing fluid exceeding a preset minimum level; and increasingly restricting fluid flow through a fluid outlet from the turbine assembly in response to a force generated by the flowing fluid exceeding a second preset level above the preset minimum level.

16. The method according to claim 15, further including the step of limiting the extent to which the turbine assembly outlet is restricted such that no further restriction occurs even if the force continues to increase, whereby a selected maximum turbine speed is obtained.

* * * * *